US012474081B2

(12) United States Patent
Thompson et al.

(10) Patent No.: US 12,474,081 B2
(45) Date of Patent: Nov. 18, 2025

(54) DAMPER FOR HVAC SYSTEM

(71) Applicant: Air Distribution Technologies IP, LLC, Milwaukee, WI (US)

(72) Inventors: Cody Christopher Thompson, Overland Park, KS (US); Brian Gerard Bellerive, Louisburg, KS (US); Jeffrey Scott Beneke, Peculiar, MO (US); Kent Steven Maune, Independence, MO (US)

(73) Assignee: Air Distribution Technologies IP, LLC, Milwaukee, WI (US)

( * ) Notice: Subject to any disclaimer, the term of this patent is extended or adjusted under 35 U.S.C. 154(b) by 752 days.

(21) Appl. No.: 17/669,269

(22) Filed: Feb. 10, 2022

(65) Prior Publication Data

US 2023/0250995 A1 Aug. 10, 2023

(51) Int. Cl.
*F24F 13/14* (2006.01)

(52) U.S. Cl.
CPC .... *F24F 13/1426* (2013.01); *F24F 2013/146* (2013.01)

(58) Field of Classification Search
CPC .. F24F 13/1426; F24F 13/084; F24F 13/1486; F24F 2013/146
USPC ..... 454/333
See application file for complete search history.

(56) References Cited

U.S. PATENT DOCUMENTS 2,670,763 A * 3/1954 Hiss ..... F16L 9/003 411/530
3,288,506 A * 11/1966 Cline ..... F24F 13/20 24/561
3,461,411 A * 8/1969 Hufnagel ..... H01F 7/08 335/276
4,219,041 A 8/1980 McCabe et al.
4,366,830 A * 1/1983 Becelaere ..... F16K 15/1821 137/75
4,380,188 A * 4/1983 Nichols ..... F24F 13/1413 454/297
RE32,362 E * 2/1987 McCabe ..... F16K 15/035 137/75

* cited by examiner

*Primary Examiner* — Steven B Mcallister
*Assistant Examiner* — Charles R Brawner
(74) *Attorney, Agent, or Firm* — Michael Best & Friedrich LLP

(57) ABSTRACT

A damper assembly includes a frame, a damper blade coupled to the frame and configured to transition between an open position and a closed position, and a latch configured to be secured within the damper assembly via a clip portion of the latch. The latch is configured to deform to facilitate transitioning of the damper blade from the open position to the closed position and then to expand to capture and retain the damper blade in the closed position.

20 Claims, 8 Drawing Sheets

DAMPER FOR HVAC SYSTEM

BACKGROUND

This section is intended to introduce the reader to various aspects of art that may be related to various aspects of the present disclosure and are described below. This discussion is believed to be helpful in providing the reader with background information to facilitate a better understanding of the various aspects of the present disclosure. Accordingly, it should be noted that these statements are to be read in this light, and not as admissions of prior art.

Heating, ventilation, and/or air conditioning (HVAC) systems are utilized in residential, commercial, and industrial environments to control environmental properties, such as temperature and humidity, for occupants of the respective environments. An HVAC system may control the environmental properties through control of a supply air flow delivered to the environment. For example, the HVAC system may place the supply air flow in a heat exchange relationship with a refrigerant of a vapor compression circuit to condition the supply air flow. The HVAC system may include ductwork through which air may flow, and the HVAC system may include a damper assembly configured to enable or block air flow through the ductwork. Unfortunately, it may be difficult to retain the damper assembly in a closed configuration to block air from flowing through the ductwork.

SUMMARY

A summary of certain embodiments disclosed herein is set forth below. It should be noted that these aspects are presented merely to provide the reader with a brief summary of these certain embodiments and that these aspects are not intended to limit the scope of this disclosure. Indeed, this disclosure may encompass a variety of aspects that may not be set forth below.

In one embodiment, a damper assembly includes a frame, a damper blade coupled to the frame and configured to transition between an open position and a closed position, and a latch configured to be secured within the damper assembly via a clip portion of the latch. The latch is configured to deform to facilitate transitioning of the damper blade from the open position to the closed position and then to expand to capture and retain the damper blade in the closed position.

In one embodiment, a damper assembly includes a frame, a first damper blade and a second damper blade rotatably coupled to the frame, and a latch coupled to the frame via a clip portion of the latch. The first damper blade and the second damper blade are configured to rotate relative to one another to transition the damper assembly between an open configuration and a closed configuration, and the latch is configured to capture and retain one of the first damper blade or the second damper blade in the closed configuration of the damper assembly.

In one embodiment, a damper assembly includes a frame forming an opening and having a protrusion extending radially inward into the opening, a damper blade coupled to the frame configured to transition between an open position and a closed position, and a latch having a clip portion configured to capture the protrusion to couple the latch to the frame. The latch has a recess configured to capture and retain the damper blade in the closed position, and the latch is configured to deform to facilitate passage of the damper blade into and out of the recess.

BRIEF DESCRIPTION OF THE DRAWINGS

Various aspects of this disclosure may be better understood upon reading the following detailed description and upon reference to the drawings in which.

DETAILED DESCRIPTION

Figure 1:
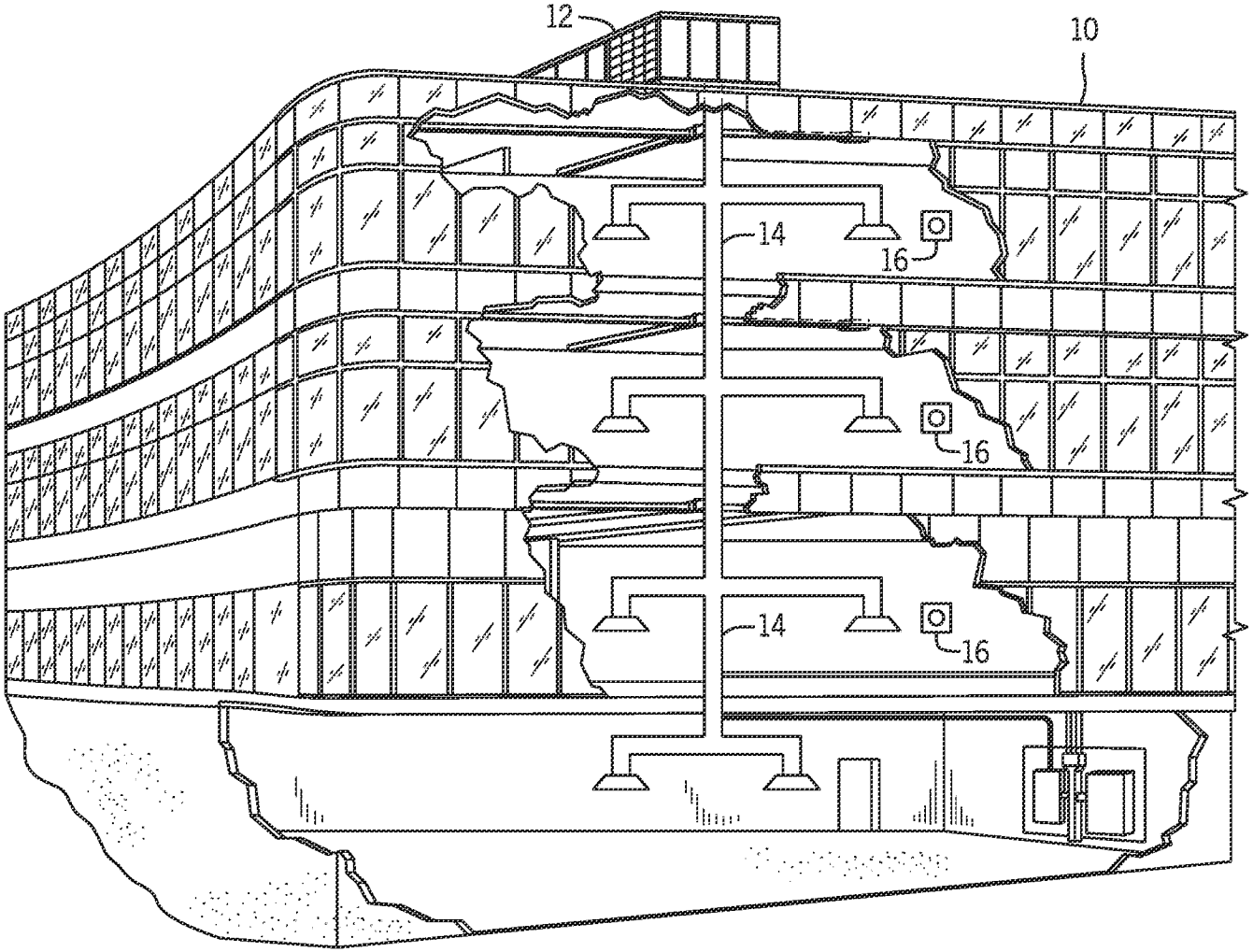
FIG. 1 is a perspective view of an embodiment of a heating, ventilation, and/or air conditioning (HVAC) system for environmental management that may employ one or more HVAC units, in accordance with an aspect of the present disclosure.

One or more specific embodiments will be described below. In an effort to provide a concise description of these embodiments, not all features of an actual implementation are described in the specification. It should be noted that in the development of any such actual implementation, as in any engineering or design project, numerous implementation-specific decisions must be made to achieve the developers' specific goals, such as compliance with system-related and business-related constraints, which may vary from one implementation to another. Moreover, it should be noted that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be noted that references to "one embodiment" or "an embodiment" of the present disclosure are not intended to be interpreted as excluding the existence of additional embodiments that also incorporate the recited features.

The present disclosure is directed to a damper assembly that may be utilized in a heating, ventilation, and/or air conditioning (HVAC) system. The damper assembly may be a part of ductwork through which air may be directed. For example, the damper assembly may enable air to be directed from a space toward the HVAC system, such as to enable the HVAC system to condition the air. Additionally or alternatively, the damper assembly may enable air (e.g., conditioned air) to be directed from the HVAC system into the space in order to condition the space.

In some circumstances, it may be desirable to block air from flowing through a portion of the ductwork. For example, it may be desirable to block contaminants, pollutants, or other unwanted particles in the air from flowing through the ductwork. Thus, the damper assembly may be configured to transition between an open configuration, in which the damper assembly enables air to flow through the ductwork, and a closed configuration, in which the damper assembly blocks air from flowing through the ductwork. In some circumstances, it may be desirable to retain the damper assembly in the closed configuration to maintain blockage of air flow through the damper assembly. Unfortunately, existing damper assemblies may not be configured to maintain the closed configuration in certain conditions. For example, the HVAC system may continue to operate and direct air toward and/or through the ductwork while the damper assembly is in the closed configuration, and the directed air may impart a force onto the damper assembly to urge the damper assembly toward the open configuration. As such, the damper assembly may undesirably enable air to flow through the ductwork.

Thus, it is presently recognized that maintaining the damper assembly in the closed configuration may improve blockage of air flow through the ductwork, as may be desired in certain conditions. Accordingly, embodiments of the present disclosure are directed to a damper assembly configured to maintain a closed configuration. For example, the damper assembly may include a frame that forms an opening through which air may flow. The damper assembly may also include one or more damper blades rotatably coupled to the frame. In the open configuration of the damper assembly, the one or more damper blades may be positioned so as to permit air to flow through the opening. In the closed configuration, the one or more damper blades may be positioned to cover the opening defined by the frame, thereby blocking air from flowing through the opening. To this end, the damper assembly includes a latch that may be secured to the frame and may capture the damper blade in the closed configuration of the damper assembly. The latch may maintain the damper assembly in the closed configuration by retaining the damper blade in a position that blocks air flow through the damper assembly. Although the present disclosure primarily discusses damper blades configured to rotate relative to the frame of the damper assembly, additional or alternative embodiments of the damper assembly may include one or more damper blades that may be adjusted in a different manner to transition between a closed position and an open position, such as by translating or sliding relative to the frame.

Turning now to the drawings, FIG. 1 illustrates an embodiment of a heating, ventilation, and/or air conditioning (HVAC) system for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

The present disclosure is directed to a damper assembly that may be utilized with or in an HVAC system. The damper assembly may include a frame and one or more damper blades coupled to and supported by the frame. The frame has an opening to enable air to flow through the damper assembly (e.g., through ductwork of the HVAC system into or out of a space within the building 10). The damper assembly may be configured to transition between an open configuration and a closed configuration to enable or block, respectively, the air from flowing through the damper assembly. For instance, in the open configuration, the damper blade may be oriented (e.g., relative to the frame) to expose the opening and enable air to flow through the damper assembly. In the closed configuration, the damper blade may be oriented (e.g., relative to the frame) to cover the opening and block air from flowing through the damper assembly.

Further, the damper assembly may include a latch configured to retain the damper blade in the closed configuration, such as by capturing the damper blade within a recess of the latch. As an example, the latch may be configured to deform and/or compress to enable translation or passage of the damper blade across the latch and into the recess of the latch. When the damper blade is positioned within the recess, the latch may extend to retain and capture the damper blade in the recess, thereby maintaining the damper assembly in the closed configuration to block air from flowing through the damper assembly. Furthermore, upon application of a sufficient or threshold force on the damper blade, the latch may be configured to release the damper blade from the recess to enable transition of the damper assembly from the closed configuration to the open configuration. For instance, a manual force of a sufficient or threshold magnitude may be applied to the damper blade to deform or actuate the latch to enable removal of the blade from the recess of the latch. In some embodiments, the latch may be coupled to the frame without the use, or in the absence, of additional fasteners or other securement components. By way of example, the frame may include a protrusion extending radially inward into the opening formed by the frame, and the latch may include a clip portion configured to capture (e.g., compress against) the protrusion in an installed configuration of the latch so as to secure the latch onto the frame. In this manner, the clip portion of the latch facilitates improved (e.g., easier) attachment and detachment of the latch with the frame.

Figure 2:
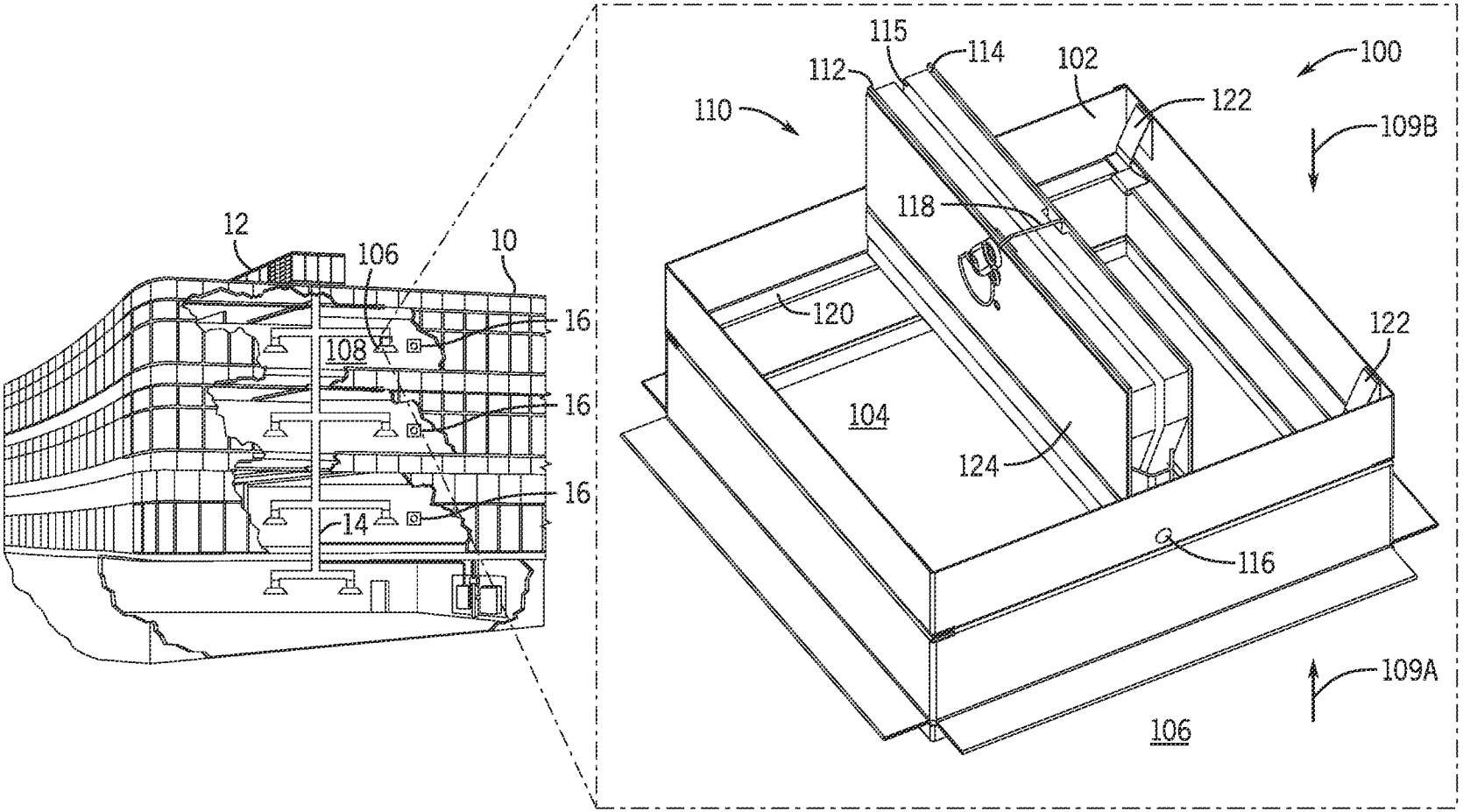
FIG. 2 is a perspective view of an embodiment of a damper assembly that may be incorporated in an HVAC system, in accordance with an aspect of the present disclosure.

With the preceding in mind, FIG. 2 is a perspective view of an embodiment of a damper assembly 100 that may be used in ductwork of an HVAC system, such as in the ductwork 14 connected to the HVAC unit 12 described above. The damper assembly 100 may include a frame 102, which may couple to and/or fit within the ductwork 14. Indeed, the frame 102 may include (e.g., define) an opening 104 through which air may flow into and/or out of the ductwork 14 in an installed configuration of the damper assembly 100. For example, the frame 102 may be positioned adjacent to an inlet/outlet 106 of the ductwork 14 to enable air (e.g., return air) to be directed out of a space 108 in the building 10 and into the ductwork 14 and/or to enable air (e.g., supply air) to be directed into the space 108 from the ductwork 14. In certain embodiments, the air may flow in a first flow direction 109A through the opening 104 of the frame 102 (e.g., from the space 108 into the ductwork 14 via the damper assembly 100, which may be positioned adjacent to an inlet of the ductwork 14). In additional or alternative embodiments, the air may flow in a second flow direction 109B through the opening 104 of the frame 102 (e.g., from the ductwork 14 into the space 108 via the damper assembly 100, which may be positioned adjacent to an outlet of the ductwork 14). The illustrated frame 102 has a square cross-sectional geometry, but additional or alternative embodiments of the frame 102 may have any suitably shaped geometry, such as a geometry that matches or corresponds with that of the ductwork 14 in order to block air from flowing between the frame 102 and the ductwork 14 and instead to direct air through the ductwork 14 via the opening 104.

In some circumstances, it may be desirable to block air flow through the opening 104 and therefore block air from flowing through a portion of the ductwork 14, such as to block air from flowing between the space 108 and the ductwork 14. For example, in certain circumstances, combustion products (e.g., smoke) may be present within the space 108 and/or within the ductwork 14, and it may be desirable to block the combustion products from flowing out of the space 108 via the ductwork 14 (e.g., from the ductwork 14 toward the space 108 and/or toward other spaces 108) in order to mitigate spread of the combustion products throughout the building 10. To this end, the damper assembly 100 may include a blade assembly 110 that may transition between an open position (e.g., corresponding to an open configuration of the damper assembly 100) and a closed position (e.g., corresponding to a closed configuration of the damper assembly 100). In the illustrated embodiment, the blade assembly 110 is in an open position to expose the opening 104, thereby enabling air to be directed through the opening 104. In the closed position, the blade assembly 110 may cover, occlude, or fill the opening 104, thereby blocking air from flowing through the opening 104. For this reason, the blade assembly 110 may have a geometry that matches the geometry of the opening 104 when the blade assembly 110 is in the closed position.

In the illustrated embodiment, the blade assembly 110 includes a first damper blade 112 and a second damper blade 114. In the open position of the illustrated blade assembly 110, inner surfaces 115 (e.g., first surfaces) of the first damper blade 112 and the second damper blade 114 may be positioned adjacent to one another (e.g., to face one another, to form an acute angle between the inner surfaces 115). Further, the first damper blade 112 and the second damper blade 114 may be rotatably coupled to one another and/or to the frame 102. By way of example, the blade assembly 110 may include a mount, such as a bracket, (not shown) that is fastened to the frame 102 at a pivot 116 (e.g., defining a pivot point of the blade assembly 110). The first damper blade 112 and the second damper blade 114 may be configured to rotate about the pivot 116 to transition the blade assembly 110 between the open position and the closed position. To transition from the open position to the closed position of the blade assembly 110, the first damper blade 112 and the second damper blade 114 may rotate such that the inner surfaces 115 transition away from one another (e.g., to form an obtuse angle between the inner surfaces 115). As such, the first damper blade 112 and the second damper blade 114 may span across the opening 104 in the closed position of the blade assembly 110 to block air flow through the opening 104.

In some embodiments, the blade assembly 110 may include a link 118 configured to hold the first damper blade 112 and the second damper blade 114 in the illustrated configuration to maintain the blade assembly 110 in the open position. As described herein, deformation, rupture, and/or removal of the link 118 may cause the first damper blade 112 and the second damper blade 114 to rotate and transition from the open position to the closed position. In the closed position, the first damper blade 112 and/or the second damper blade 114 may abut against a protrusion 120 (e.g., a flange) of the frame 102 extending radially inward into the opening 104. The abutment between the protrusion 120 with the first damper blade 112 and/or the second damper blade 114 may create a seal that blocks air flow between the frame 102 and the blade assembly 110, thereby blocking air from flowing through the opening 104.

In certain embodiments, the damper assembly 100 may include one or more latches 122 configured to receive one of the first damper blade 112 or the second damper blade 114 in the closed position of the blade assembly 110. The latch 122 may, for instance, be removably coupled to the protrusion 120 and, when the blade assembly 110 transitions from the open position to the closed position, the latch 122 may capture a portion of one of the first damper blade 112 or the second damper blade 114 to maintain positioning of the first damper blade 112 and/or the second damper blade 114 adjacent to or against the protrusion 120. The latch 122 may therefore retain the blade assembly 110 in the closed position to block air from flowing through the opening 104 (e.g., by blocking movement of the first damper blade 112 and/or the second damper blade 114 away from the protrusion 120). Indeed, the latch 122 may be configured to retain the blade assembly 110 in the closed position despite application of a force onto the blade assembly 110, such as a force imparted by an air flow impinging on the blade assembly 110. In embodiments in which air flows in the first flow direction 109A, the latches 122 may be positioned at a downstream or discharge portion of the frame 102 (e.g., air flow being discharged from the damper assembly 100 may come into contact with the latches 122). In embodiments in which air flows in the second flow direction 109B, the latches 122 may be positioned at an upstream or intake portion of the frame 102 (e.g., air flow entering the damper assembly 100 may come into contact with the latches 122). Although FIG. 2 illustrates two latches 122 configured to capture the second damper blade 114 in the closed position of the blade assembly 110, the damper assembly 100 may include any suitable number of latches 122, such as one latch 122, or more than two latches 122, to capture the second damper blade 114. In addition, the damper assembly 100 may include any suitable number of latches 122 configured to similarly capture the first damper blade 112 for retention in the closed position.

In some implementations, the blade assembly 110 may be manually transitioned from the closed position to the open position, thereby transitioning the damper assembly 100 from the closed configuration to the open configuration. As an example, a user (e.g., an operator, a technician, an occupant) may exert a force onto the blade assembly 110 to rotate the first damper blade 112 and/or the second damper blade 114 relative to the frame 102 and/or relative to one another. Specifically, application of a force may release the first damper blade 112 or the second damper blade 114 from the latch 122 and move the inner surfaces 115 toward one another. To this end, outer surfaces 124 of the first damper blade 112 and the second damper blade 114 may be exposed to the space 108 in the closed position of the blade assembly 110. Thus, the user may access the outer surfaces 124 to impart a sufficient force that enables release of the first damper blade 112 and the second damper blade 114 from the latches 122. In this manner, the damper assembly 100 may transition from the closed configuration to the open configuration without the use of a control system (e.g., an electronic controller), thereby reducing costs associated with the manufacture and/or the operation of the damper assembly 100.

Figure 3:
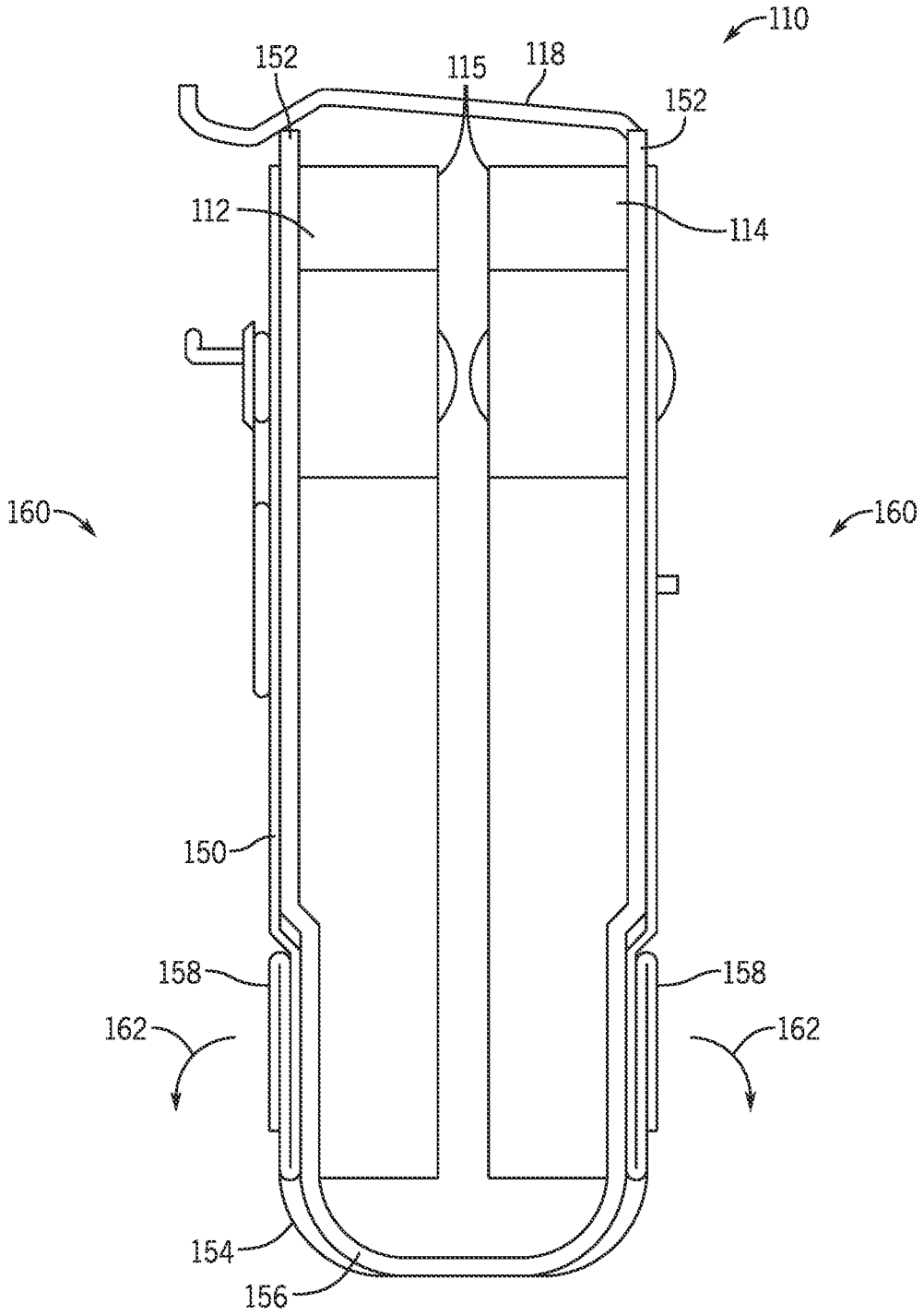
FIG. 3 is a side view of an embodiment of a blade assembly that may be incorporated in a damper assembly, in accordance with an aspect of the present disclosure.

FIG. 3 is a side view of an embodiment of the blade assembly 110 in the open position. Each of the first damper blade 112 and the second damper blade 114 may be coupled to a common support 150 (e.g., a support structure, a spine, etc.). The link 118 may couple to and span across first portions 152 (e.g., distal ends) of the blade assembly 110 to retain the blade assembly 110 in the open position. Thus, in the open position of the blade assembly 110, the support 150 may have a U-shaped configuration. Additionally, a hinge 154 (e.g., an integral spring hinge) may be attached to a second portion 156 (e.g., a center) of the support 150. The hinge 154 may impart a force onto the support 150 to bias the first portions 152 away from one another and move the blade assembly 110 toward the closed position. Thus, the link 118 coupled to the first portions 152 may resist or counteract the biasing force of the hinge 154 to retain the blade assembly 110 in the open position (e.g., by compressing the first portions 152 toward one another) and block the first portions 152 from moving away from one another.

The support 150 may include attachments 158 positioned on opposite sides 160 of the support 150 in the open position of the blade assembly 110. Each attachment 158 may include a slot in which ends of the hinge 154 may be inserted. For example, the hinge 154 may be crimped into the slots of the attachment 158, coupled to the support 150 via fasteners, or otherwise secured to the support 150 such that the hinge 154 is integral to the support 150 and/or blade assembly 110. Thus, the hinge 154 may also have a U-shaped configuration in the open position of the blade assembly 110. The ends of the hinge 154 may exert a torque onto the attachments 158 to urge the sides 160 of the support 150 to rotate in respective rotational directions 162 (e.g., to increase the angle between the inner surfaces 115 of the damper blades 112, 114).

As such, when the link 118 is removed or ruptured and therefore does not counteract or resist the biasing force of the hinge 154, the hinge 154 may cause the sides 160 of the support 150 to rotate away from one another (e.g., in rotational directions 162), thereby transitioning the support 150 from the U-shape to a more level (e.g., flat) configuration associated with the closed position of the blade assembly 110. The level configuration may enable the blade assembly 110 to span across the opening 104 and block air from flowing through the opening 104. The hinge 154 may continue to apply a force/torque against the attachments 158 to maintain the blade assembly 110 in the closed position. In certain embodiments, the link 118 may be made from a material (e.g., a metallic material) that deforms (e.g., plastically deforms) at a threshold temperature. That is, when the link 118 is exposed to the threshold temperature, the link 118 may deform, such as melt or rupture, to release the first portions 152 and cause the blade assembly 110 to transition to the closed position, thereby blocking air from flowing through the damper assembly 100.

In some embodiments, the hinge 154 may be manufactured, designed, selected, or otherwise implemented based on an application of the blade assembly 110. As an example, a thickness of the hinge 154 may be manufactured based on an expected rate of air flow directed through the opening 104, a material of the support 150, a size of the damper blades 112, 114, and so forth. In some embodiments, the hinge 154 may have a thickness that is greater than or equal to approximately 0.02 centimeters (0.008 inches) to provide a sufficient biasing force that enables transition and maintenance of the blade assembly 110 in the closed position, while enabling the blade assembly 110 to transition from the closed position to the open position via a manually applied force. For example, material properties and/or dimensions of the hinge 154 may be selected to enable the blade assembly 110 to resist movement upon application of a first force imparted by an air flow on the damper blades 112, 114, while also enabling movement of the damper blades 112, 114 upon application of a second force, greater than the first force, that may be manually applied to the blade assembly 110.

Figure 4:
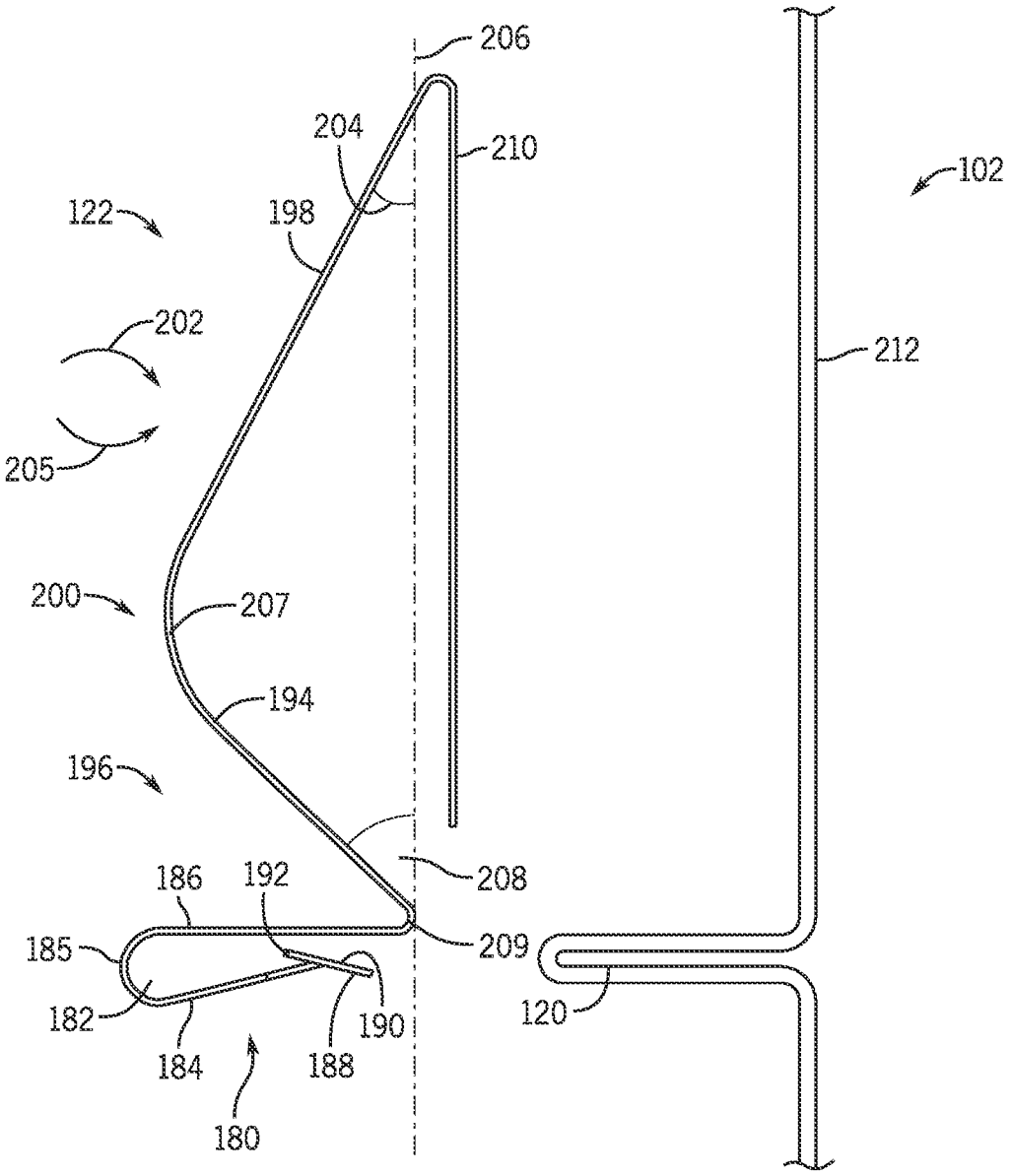
FIG. 4 is a side view of an embodiment of a latch that may be incorporated in a damper assembly, in accordance with an aspect of the present disclosure.

FIG. 4 is a side view of an embodiment of the latch 122 that may be used to capture one of the damper blades 112, 114 to retain the blade assembly 110 in the closed position. The latch 122 may be configured to couple to the frame 102 via attachment to the protrusion 120 of the frame 102. For example, the latch 122 may include a clip portion 180 that is configured to capture the protrusion 120 in an installed configuration of the latch 122. The clip portion 180 may be shaped to form a first recess 182 in which the protrusion 120 is disposed in the installed configuration. For instance, the clip portion 180 includes a first segment 184, a bend 185, and a second segment 186 (e.g., to form a hook-like shape). As shown, the first segment 184 and the second segment 186 extend from the bend 185, and the first segment 184 extends at least partially toward the second segment 186 from the bend 185. As discussed below, the configuration of the clip portion 180 enables application of a force on the protrusion 120 by the clip portion 180 to capture the protrusion 120 within the first recess 182.

During installation of the latch 122, the first segment 184 and the second segment 186 are positioned on opposite sides of the protrusion 120, such that the protrusion 120 is disposed within the first recess 182. Contact between the protrusion 120 and the first segment 184 may bias the first segment 184 away from the second segment 186. Such relative movement between the first segment 184 and the second segment 186 may cause elastic deformation of the latch 122, whereby the first segment 184 and the second segment 186 are biased toward one another. Thus, in the installed configuration of the latch 122, the first segment 184 and the second segment 186 may impart a compressive force onto the protrusion 120, thereby securing the latch 122 onto the frame 102. Indeed, the clip portion 180 may enable the latch 122 to be coupled to the protrusion 120 and secured within the damper assembly 100 without the use of additional fasteners or securement components.

In certain embodiments, the clip portion 180 may include a guide portion 188 positioned at an end of the first segment 184. The guide portion 188 may facilitate insertion of the protrusion 120 into the first recess 182. To this end, the guide portion 188 may be sloped or angled relative to the first segment 184, such that a surface 190 of the guide portion 188 faces the protrusion 120 during installation of the latch 122. This arrangement of the guide portion 188 may guide the protrusion 120 into the first recess 182. In addition, a barb or edge 192 of the guide portion 188 may extend into the first recess 182 from the end of the first segment 184. As such, in the installed configuration of the latch 122, the edge 192 of the guide portion 188 may facilitate application of a force against the protrusion 120 to block removal of the protrusion 120 from the first recess 182, thereby retaining the latch 122 in the installed configuration.

A third segment 194 of the latch 122 may extend from the second segment 186 to form a second recess 196 of the latch 122. The second recess 196 may receive one of the damper blades 112, 114 in the closed position of the blade assembly 110. Thus, the third segment 194 may be oriented relative to the second segment 186 to form the second recess 196 having a shape that may capture a portion of the damper blade 112, 114 in the closed position. In this way, unintentional removal of the damper blade 112, 114 from the second recess 196 (e.g., via force applied by an air flow) is mitigated. Positioning of the damper blade 112, 114 within the second recess 196 may further provide a seal or create a sealing interface between the damper blade 112, 114 and the latch 122 that blocks air from flowing between the damper blade 112, 114 and the frame 102 (e.g., between the damper blade 112, 114 and the latch 122).

A fourth segment 198 of the latch 122 may extend from the third segment 194 to form a crown or crest portion 200. As described herein, the crown portion 200 may be shaped to enable deformation (e.g., compression) of the crown portion 200 when the damper blade 112, 114 contacts and translates along the fourth segment 198 as the damper blade 112, 114 rotates in a first rotational direction 202. Thus, the configuration of the crown portion 200 enables transition of the damper blade 112, 114 into the second recess 196. For instance, in the installed configuration of the latch 122, the fourth segment 198 may be sloped to form a first angle 204 relative to a vertical axis 206 such that abutment of the damper blade 112, 114 against the fourth segment 198 (e.g., as a result of movement in the first rotational direction 202) guides the damper blade 112, 114 to compress the crown portion 200 and to travel into the second recess 196.

However, the crown portion 200 may block the damper blade 112, 114 from being easily removed from the second recess 196 without application of a sufficient force (e.g., a manual force) to rotate the damper blade 112, 114 in a second rotational direction 205 opposite the first rotational direction 202. That is, in the installed configuration of the latch 122, the third segment 194 may form a second angle 208 relative to the vertical axis 206 that enables the third segment 194 to retain the damper blade 112, 114 within the second recess 196. Indeed, the second angle 208 may be greater than the first angle 204. Therefore, a first force applied to the damper blade 112, 114 that enables compression of the crown portion 200 via engagement between the damper blade 112, 114 and the third segment 194 (e.g., to release the damper blade 112, 114 from the second recess 196) may be greater than a second force applied to the damper blade 112, 114 that enables compression of the crown portion 200 via engagement between the damper blade 112, 114 and the fourth segment 198 (e.g., to enable insertion of the damper blade 112, 114 into the second recess 196). The third segment 194 and the fourth segment 198 may be oriented relative to one another such that the crown portion 200 includes a first arcuate segment 207 having a first, larger radius (e.g., 0.6 centimeters or 0.25 inches). Additionally, the second segment 186 and the third segment 194 may be oriented relative to one another to form a second arcuate segment 209 between the second segment 186 and the third segment 194 having a second, smaller radius (e.g., 0.05 centimeters or 0.02 inches). The first, larger radius may enable deformation of the crown portion 200 via movement of the damper blade 112, 114 toward the second recess 196, and the second, smaller radius may enable retention of the damper blade 112, 114 within the second recess 196.

The latch 122 may also include a fifth segment 210 extending from the fourth segment 198. In the installed configuration of the latch 122, the fifth segment 210 may abut against an external frame portion 212 (e.g., an inner surface of the external frame portion 212) of the frame 102, and the crown portion 200 may extend away from the external frame portion 212 (e.g., toward the opening 104). The abutment between the fifth segment 210 and the external frame portion 212 may block undesired or unintentional movement (e.g., rotation) between the latch 122 and the frame 102. However, the abutment between the fifth segment 210 and the external frame portion 212 may nonetheless enable deformation of the crown portion 200. For example, compression of the crown portion 200 may cause the fifth segment 210 to translate along the external frame portion 212 (e.g., along the inner surface of the external frame portion 212, along the vertical axis 206).

Figure 5:
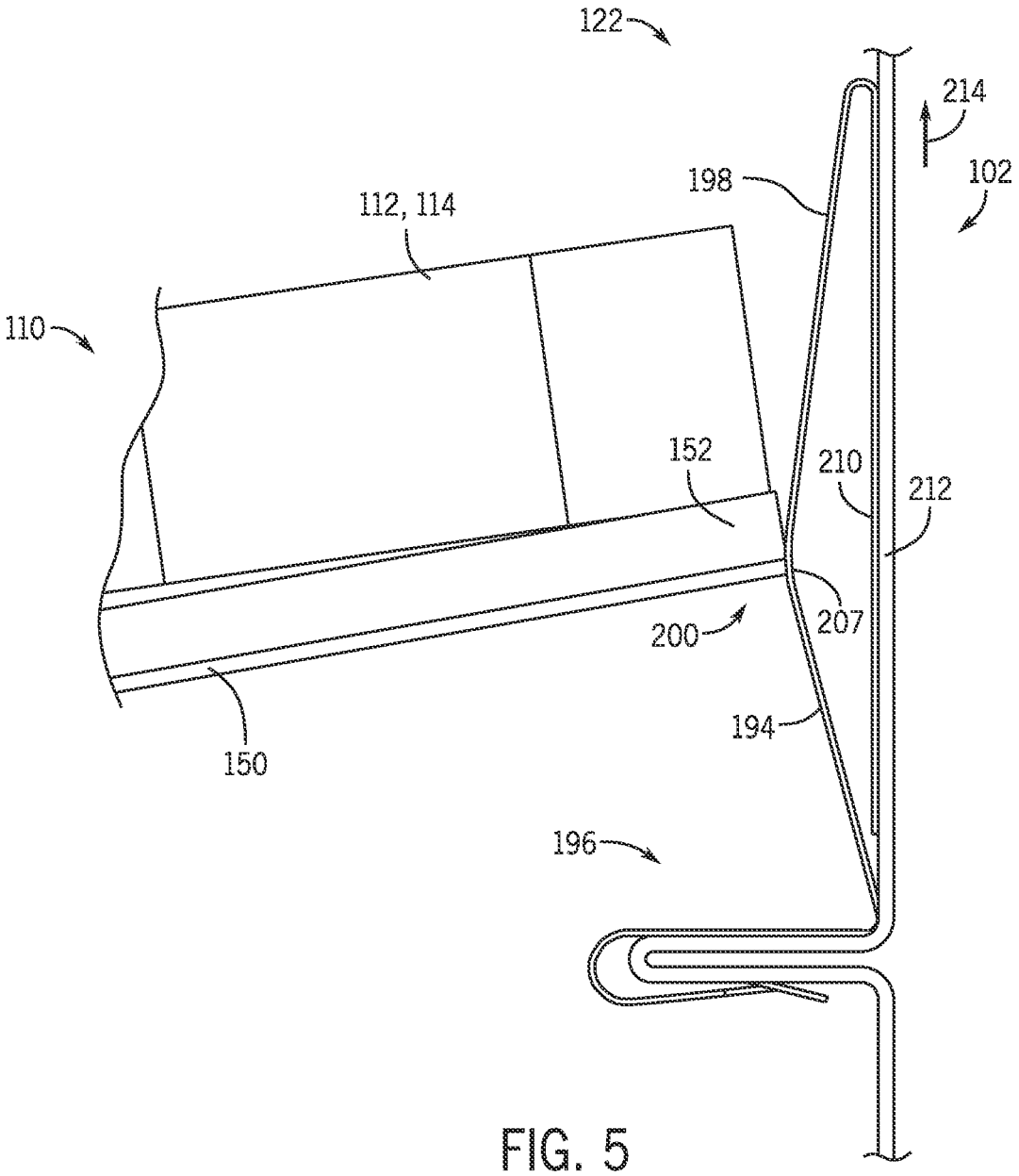
FIG. 5 is a partial side view of an embodiment of a damper assembly, illustrating a damper blade of a blade assembly transitioning between a closed position and an open position, in accordance with an aspect of the present disclosure.

FIG. 5 is a partial side view of an embodiment of the damper assembly 100, illustrating transition or passage of one of the damper blades 112, 114 between the closed position and the open position with the latch 122 in the installed configuration. The transition between the closed position and the open position may cause the damper blade 112, 114 to deform the crown portion 200 of the latch 122. That is, the damper blade 112, 114 may reduce a distance spanning between the external frame portion 212 and the crown portion 200 in order to enable insertion and/or removal of the damper blade 112, 114 from the second recess 196. As an example, deformation of the crown portion 200 may cause the third segment 194 to move (e.g., bend, pivot, rotate) away from the fourth segment 198, thereby increasing an angle formed between the third segment 194 and the fourth segment 198 and increasing a radius of the first arcuate segment 207 of the crown portion 200. Further, the abutment between the fifth segment 210 and the external frame portion 212 may facilitate deformation of the crown portion 200, and the deformation of the crown portion 200 may cause the fifth segment 210 to linearly translate along the external frame portion 212 in a direction 214.

Figure 6:
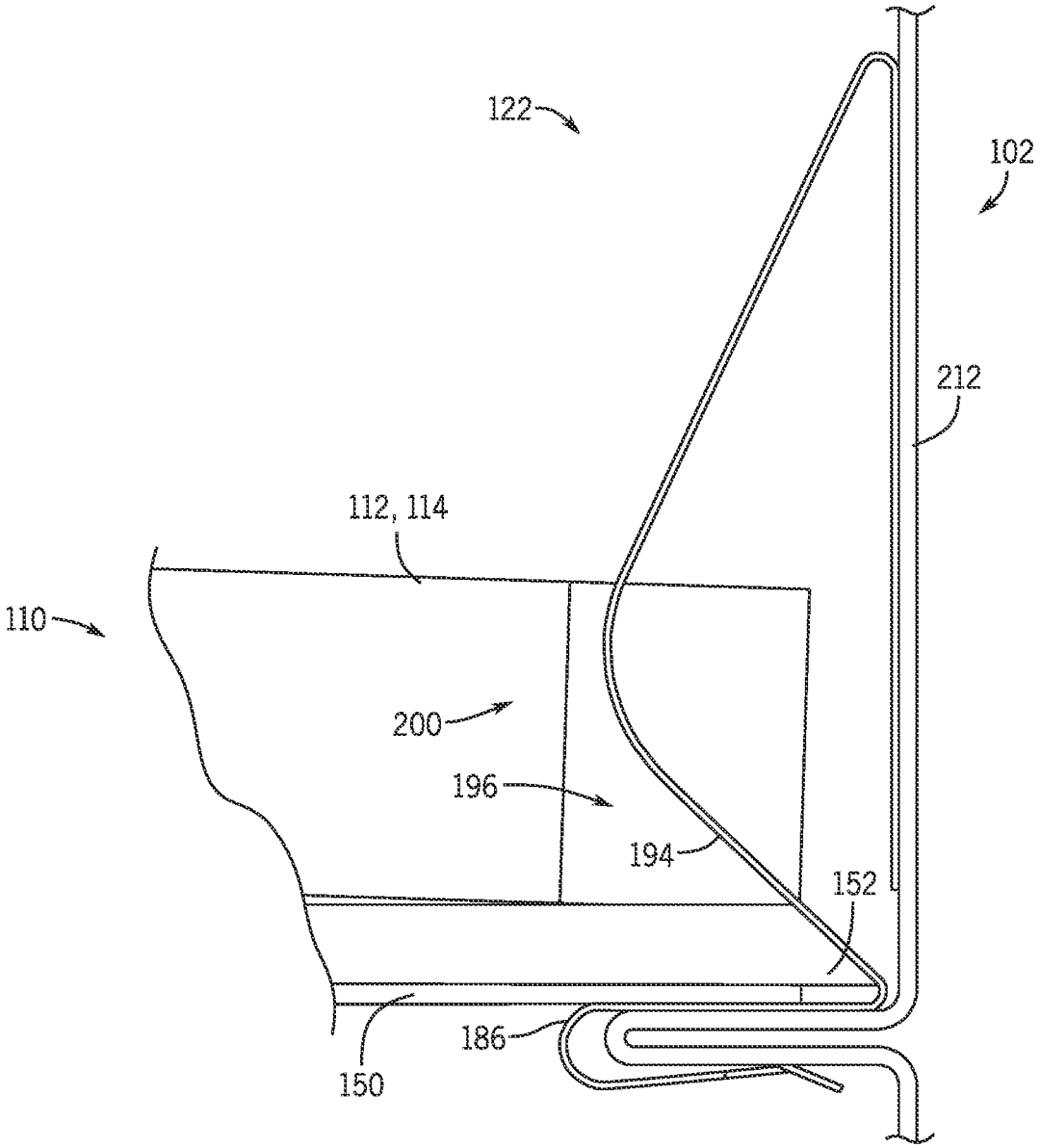
FIG. 6 is a partial side view of an embodiment of a damper assembly, illustrating a damper blade of a blade assembly in a closed position, in accordance with an aspect of the present disclosure.

FIG. 6 is a partial side view of an embodiment of the damper assembly 100, illustrating one of the damper blades 112, 114 in the closed position of the blade assembly 110. That is, the damper blade 112, 114 is disposed within the second recess 196, such as after deformation of the crown portion 200 to enable movement of the damper blade 112, 114 into the second recess 196. As illustrated in FIG. 6, in the closed position of the blade assembly 110, the crown portion 200 may have an undeformed shape. Indeed, the latch 122 may undergo elastic deformation during transition of the blade assembly 110 between the open position and the closed position as the damper blade 112, 114 (e.g., the first portion 152 of the blade assembly 114) contacts and travels along the latch 122 in the manner described above. When the damper blade 112, 114 is positioned within the second recess 196 and no longer imparts a force on the latch 122 (e.g., on the third segment, 194, the crown portion 200, and/or the fourth segment 198), the latch 122 may return to the undeformed shape shown in FIG. 6.

The undeformed shape of the latch 122 (e.g., the crown portion 200) may enable capture and retention of the damper blade 112, 114 within the second recess 196. In some embodiments, the undeformed shape of the crown portion 200 may extend into an aperture or a recess formed in a portion of the damper blade 112, 114, such that the latch 122 captures the support 150 and retains the damper blade 112, 114 in the closed position. For instance, in the closed position of the blade assembly 110, each of the second segment 186 and the third segment 194 may abut a portion of the blade assembly 110 (e.g., the first portion 152 of the blade assembly 114). In this manner, the latch 122 may capture the damper blade 112, 114 within the second recess 196 and resist removal of the damper blade 112, 114 from the second recess 196. In certain embodiments, engagement between the latch 122 and the damper blade 112, 114 in the closed position of the blade assembly 110 may provide or create a seal therebetween that blocks air from flowing between the damper blade 112, 114 and the latch 122 (e.g., between the damper blade 112, 114 and the second segment 186, between the damper blade 112, 114 and the third segment 194).

Figure 7:
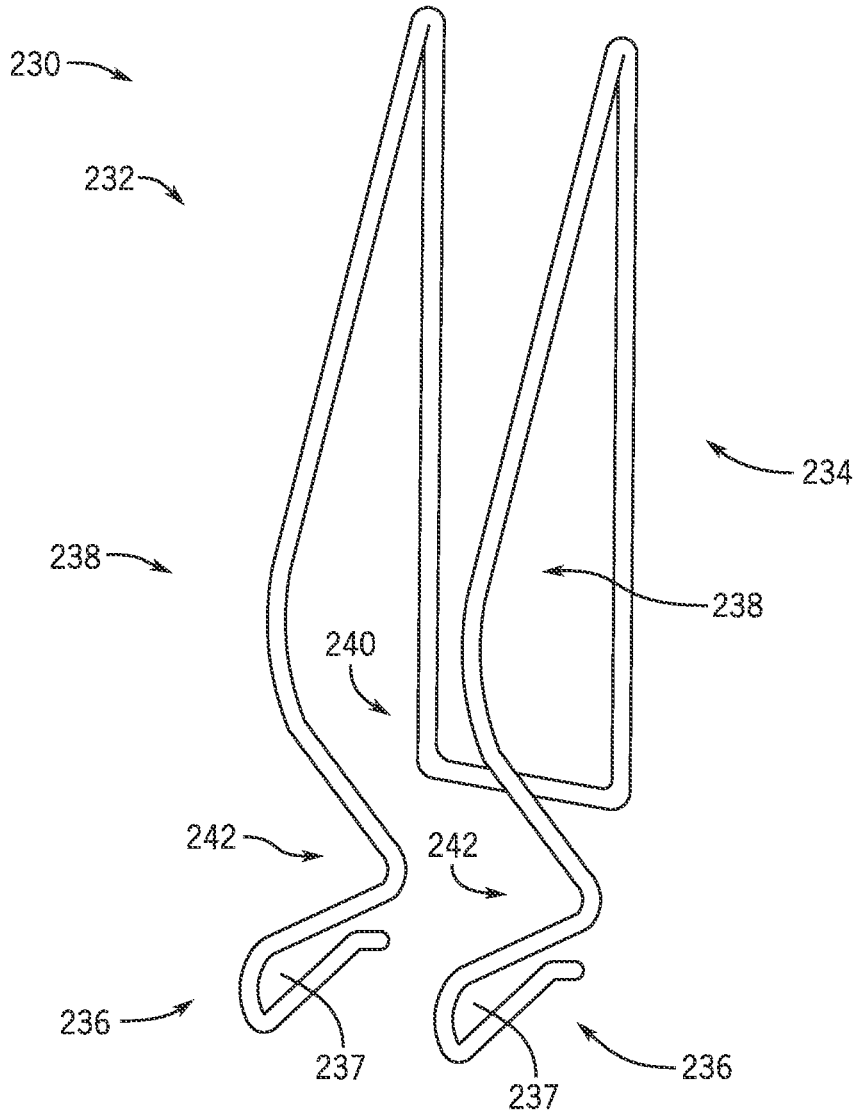
FIG. 7 is a perspective view of an embodiment of a latch that may be incorporated in a damper assembly, in accordance with an aspect of the present disclosure.

FIG. 7 is a perspective view of an embodiment of a latch 230 having a wireform structure. The wireform structure may include wiring that is bent to form the geometry and features of the latch 230, which may be similar to the geometry and features of the latch 122 illustrated in FIGS. 2-6. For example, the latch 230 may include a single integral wire (e.g., a single piece) or multiple wires that are coupled to one another. In any case, the latch 230 may be formed from less material than the latch 122 described above. Therefore, the latch 230 may be lighter and/or may be manufactured at a reduced cost as compared to the latch 122. The latch 230 may include a first section 232 (e.g., a first lateral section) and a second section 234 (e.g., a second lateral section) that are similarly shaped to one another. Each of the sections 232, 234 may include a respective clip portion 236 that has a similar configuration as the clip portion 180 of the latch 122. Indeed, the clip portions 236 may each include a respective first recess 237. Each of the sections 232, 234 may also include a respective crown portion 238 that has a similar configuration as the crown portion 200 of the latch 122. Moreover, the latch 230 may include a shared section 240 (e.g., common section, linking segment, etc.) coupling the sections 232, 234 to one another. In the installed configuration of the latch 230, the protrusion 120 of the frame 102 may be positioned within the first recesses 237, and the clip portions 236 may capture the protrusion 120 to secure the latch 230 onto the frame 102. The shared section 240 may abut the external frame portion 212 in the installed configuration of the latch 230.

Furthermore, during transition of one of the damper blades 112, 114 between the open position and the closed position of the blade assembly 110, the damper blade 112, 114 may deform the crown portions 238 in a manner similar to that described above with respect to the latch 122. The shared section 240 may linearly translate along the external frame portion 212 to facilitate deformation of the crown portions 238. In the closed position of the blade assembly 110, the damper blade 112, 114 may be positioned and retained within second recesses 242 formed by the latch 230. Indeed, the latch 230 may be configured to retain the damper blade 112, 114 in the closed position upon impingement of an air flow against the damper blade 112, 114. Further still, the geometry of the latch 230 (e.g., the radius of the crown portions 238) may enable transition of the blade assembly 110 from the closed position to the open position upon application of a sufficient or threshold force (e.g., manual force) to the damper blade 112, 114. Indeed, the sufficient or threshold force may be applied by an operator or user located within a conditioned space without otherwise accessing ductwork to which the damper assembly 100 is coupled.

Figure 8:
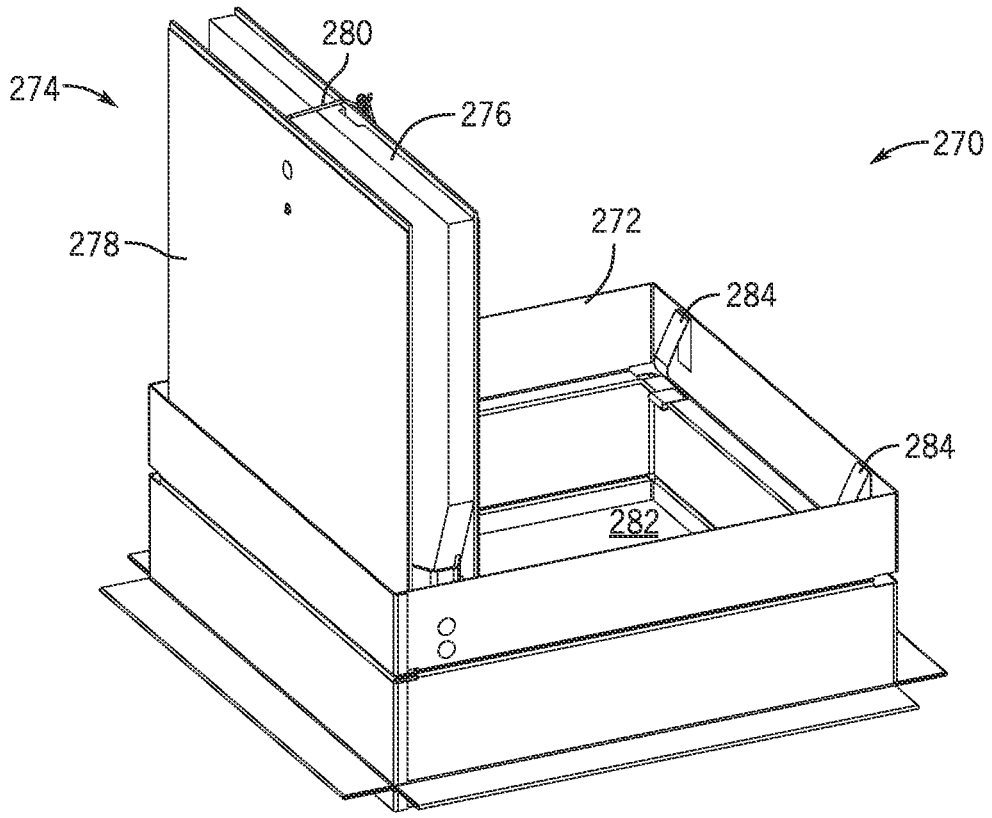
FIG. 8 is a perspective view of an embodiment of a damper assembly that may be incorporated in an HVAC system, in accordance with an aspect of the present disclosure.

FIG. 8 is a perspective view of an embodiment of a damper assembly 270 having a single damper blade 276. The damper assembly 270 includes a frame 272 and a blade assembly 274, including the single damper blade 276, rotatably coupled to the frame 272. The damper assembly 270 may also include a backing 278 (e.g., a support, a plate, a sheet, a panel, a board) that is fixedly coupled to the frame 272. In the open position of the blade assembly 274 (e.g., in the open configuration of the damper assembly 270), a link 280 may couple the damper blade 276 to the backing 278. Upon deformation, rupture, and/or removal of the link 280 (e.g., plastic deformation of the link 280 caused by exposure to a threshold temperature), the damper blade 276 may rotate relative to the frame 272 and relative to the backing 278 to the closed position. For example, the blade assembly 274 may include a hinge (not shown) coupling the damper blade 276 to the backing 278 and/or to the frame 272. The hinge may impart a biasing force that rotates the blade assembly 274 away from the backing 278 to span across an opening 282 formed by the frame 272, thereby blocking air from flowing through the frame 272. Latches 284 of the damper assembly 270 may capture the damper blade 276 and may retain the damper blade 276 in the closed position of the blade assembly 274, as similarly described above. However, the latches 284 may enable transition of the blade assembly 274 from the closed position to the open position upon application of a sufficient force (e.g., a manually applied force) to the blade assembly 274. Therefore, the latches 284 may enable the blade assembly 274 to be positioned and retained, as desired, in the closed position or in the open position. Although the illustrated damper assembly 270 includes two latches 284, the damper assembly 270 may include any suitable number of latches 284 to retain the blade assembly 274 in the closed position.

The present disclosure may provide one or more technical effects useful in the operation of an HVAC system. For example, the HVAC system may include a damper assembly that may enable or block air flow through ductwork of the HVAC system. The damper assembly may include a frame and a damper blade. The frame may form an opening through which air may flow, and the damper blade may transition between an open position, whereby air flow through the opening is enabled, and a closed position, whereby air flow through the opening is blocked. The damper assembly may also include a latch configured to maintain the damper blade in the closed position. For instance, the latch may form a recess that captures and retains the damper blade in the closed position, and the latch may deform to facilitate translation of the damper blade into the recess. The latch may retain the damper blade in the closed position upon impingement of an air flow against the damper blade. Further, a sufficient or threshold force (e.g., a manual force) imparted onto the damper blade may cause the damper blade to elastically deform the latch and facilitate translation of the damper blade out of the recess, thereby transitioning the damper blade from the closed position to the open position. Thus, the latch may enable the damper blade to be positioned as desired. The technical effects and technical problems in the specification are examples and are not limiting. It should be noted that the embodiments described in the specification may have other technical effects and can solve other technical problems.

While only certain features and embodiments of the disclosure have been illustrated and described, many modifications and changes may occur to those skilled in the art, such as variations in sizes, dimensions, structures, shapes and proportions of the various elements, values of parameters, including temperatures and pressures, mounting arrangements, use of materials, colors, orientations, and so forth without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described, such as those unrelated to the presently contemplated best mode of carrying out the disclosure, or those unrelated to enabling the claimed disclosure. It should be noted that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A damper assembly, comprising:
a frame;
a damper blade coupled to the frame, wherein the damper blade is configured to transition between an open position and a closed position; and
a latch configured to be secured within the damper assembly via a clip portion of the latch, wherein the latch is configured to deform to facilitate transitioning of the damper blade from the open position to the closed position and then to expand to capture and retain the damper blade in the closed position,
wherein the latch comprises
a crown portion configured to compress towards the frame as the damper blade transitions from the open position to the closed position, and
a recess defined by a segment of the crown portion and a segment of the clip portion, the recess configured to capture the damper blade in the closed position, and
wherein the segment of the crown portion is positioned at an acute angle relative to the segment of the clip portion such that when the damper blade is in the closed position, a threshold force exerted on the damper blade on a surface opposite the crown portion releases the damper blade from the latch.

2. The damper assembly of claim 1, wherein the damper blade is coupled to the frame via an integral spring hinge.

3. The damper assembly of claim 2, wherein the integral spring hinge comprises a thickness that is greater than or equal to 0.008 inches.

4. The damper assembly of claim 1, wherein the damper blade is configured to rotate relative to the frame.

5. The damper assembly of claim 1, wherein the frame comprises an external frame portion and a protrusion extending radially inward relative to the external frame portion, and the clip portion of the latch is configured to capture the protrusion in an installed configuration of the latch.

6. The damper assembly of claim 5, wherein the latch comprises a vertical segment configured to abut an inner surface of the external frame portion in the installed configuration, the vertical segment extending from the crown portion toward the clip portion.

7. The damper assembly of claim 6, wherein the crown portion extends away from the external frame portion in the installed configuration, and when the crown portion compresses, the vertical segment translates along the inner surface of the external frame portion.

8. The damper assembly of claim 1, wherein the segment of the crown portion partially defines a first arcuate segment with a first radius, the segment of the clip portion partially defines a second arcuate segment with a second radius, and the first radius is greater than the second radius.

9. The damper assembly of claim 1, wherein the latch comprises a wireform structure.

10. A damper assembly, comprising:
a frame;
a first damper blade and a second damper blade rotatably coupled to the frame, wherein the first damper blade and the second damper blade are configured to rotate relative to one another to transition the damper assembly between an open configuration and a closed configuration; and a latch coupled to the frame via a clip portion of the latch, wherein the latch is configured to capture and retain one of the first damper blade or the second damper blade in the closed configuration of the damper assembly, wherein the latch is configured to capture and retain the one of the first damper blade or the second damper blade in the closed configuration of the damper assembly, the latch comprising a first segment, a second segment, and a third segment, the first segment and the second segment are oriented relative to one another to form a recess configured to capture and retain the one of the first damper blade or the second damper blade in the closed configuration of the of the damper assembly, and the second segment and the third segment are oriented relative to one another to form a crown portion configured to compress to facilitate passage of the one of the first damper blade or the second damper blade into the recess, and wherein the second segment forms a first acute angle relative to a vertical axis, the third segment forms a second acute angle relative to the vertical axis, and the first acute angle is greater than the second acute angle, such that when the one of the first damper blade or the second damper blade is in the closed position, a threshold force exerted on the one of the first damper blade or the second damper blade on a surface opposite the crown portion releases the one of the first damper blade or the second damper blade from the latch.

11. The damper assembly of claim 10, wherein the first damper blade and the second damper blade are coupled to one another via an integral spring hinge.

12. The damper assembly of claim 11, wherein the integral spring hinge is configured to bias the first damper blade and the second damper blade toward the closed configuration of the damper assembly.

13. The damper assembly of claim 10, wherein the latch is a first latch configured to capture the first damper blade in the closed configuration of the damper assembly, and the damper assembly comprises a second latch coupled to the frame and configured to capture and retain the second damper blade in the closed configuration of the damper assembly.

14. The damper assembly of claim 10, comprising a metallic link configured to compress the first damper blade and the second damper blade toward one another to maintain the damper assembly in the open configuration, and the metallic link is configured to deform at a threshold temperature to enable the first damper blade and the second damper blade to rotate and transition the damper assembly to the closed configuration.

15. A damper assembly, comprising:

a frame forming an opening, wherein the frame comprises a protrusion extending radially inward into the opening;

a damper blade coupled to the frame, wherein the damper blade is configured to transition between an open position and a closed position; and a latch comprising a clip portion configured to capture the protrusion to couple the latch to the frame, wherein the latch comprises a recess configured to capture and retain the damper blade in the closed position, and the latch is configured to deform to facilitate passage of the damper blade into and out of the recess, wherein the latch comprises a crown portion configured to compress towards an inner surface of the frame as the damper blade passes into the recess, and a vertical segment configured to abut the inner surface of frame portion, the vertical segment extending from the crown portion toward the clip portion, and wherein when the crown portion compresses, the vertical segment to translates along the inner surface the frame.

16. The damper assembly of claim 15, wherein the clip portion is configured to secure the latch to an upstream portion of the frame, a downstream portion of the frame, or both.

17. The damper assembly of claim 15, comprising a backing and a link, wherein the backing is fixedly coupled to the frame, and the link is configured to couple to the damper blade and the backing to maintain the damper blade in the open position.

18. The damper assembly of claim 15, wherein a recess is defined by a segment of the crown portion and a segment of the clip portion, the recess configured to capture the damper blade in a closed position, and wherein the segment of the crown portion is positioned at an acute angle relative to the segment of the clip portion, such that when the damper blade is in the closed position, a threshold force exerted on the damper blade on a surface opposite the crown portion releases the damper blade from the latch.

19. The damper assembly of claim 15, wherein the vertical segment is oriented at an acute angle relative to the crown portion.

20. The damper assembly of claim 15, wherein the vertical segment extends along a majority of a length of the latch.

* * * * *